US006942115B2

(12) United States Patent
Jimenez et al.

(10) Patent No.: US 6,942,115 B2
(45) Date of Patent: Sep. 13, 2005

(54) PROTECTIVE PACKAGING UNIT

(75) Inventors: Rodrigo Jimenez, Surrey (GB); John David Lamb, Wiltshire (GB); Richard Paul McNabb, Wirral (GB); Ian Stuart Midgley, Leeds (GB)

(73) Assignee: Unilever Home & Personal Care USA, division of Conopco, Inc., Chicago, IL (US)

( * ) Notice: Subject to any disclaimer, the term of this patent is extended or adjusted under 35 U.S.C. 154(b) by 215 days.

(21) Appl. No.: 09/964,298

(22) Filed: Sep. 26, 2001

(65) Prior Publication Data

US 2002/0036180 A1 Mar. 28, 2002

(30) Foreign Application Priority Data

Sep. 28, 2000 (GB) ..... 0023798

(51) Int. Cl.[7] ..... B65D 51/18
(52) U.S. Cl. ..... 215/277; 220/256.1
(58) Field of Search ..... 215/277, 386, 215/395, 121; 150/154; 206/527, 485, 815, 446; 220/256.1, 257.1, 257.2, 258.1, 258.2, 23.91, 8, 780, 784, 796, 732, 797; D9/443–445, 435; 222/23, 9, 153.1, 182, 184

(56) References Cited

U.S. PATENT DOCUMENTS

| | | | | |
|---|---|---|---|---|
| 601,117 A | * | 3/1898 | Beal | 215/251 |
| 2,162,998 A | | 6/1939 | Fisher | |
| 3,507,416 A | | 4/1970 | Douglas et al. | 215/12 |
| 3,581,926 A | * | 6/1971 | Eberhard | 215/330 |
| D292,967 S | * | 12/1987 | Gagnon | D9/439 |
| D327,431 S | * | 6/1992 | Farricielli | D9/444 |
| D328,429 S | * | 8/1992 | Ben-uri | D9/434 |
| D375,455 S | * | 11/1996 | Uhl et al. | D9/300 |
| 5,702,003 A | | 12/1997 | Springer | 206/457 |
| 5,921,431 A | * | 7/1999 | Pych | 220/742 |
| D438,110 S | * | 2/2001 | Dailey et al. | D9/445 |

FOREIGN PATENT DOCUMENTS

| | | |
|---|---|---|
| GB | 412609 | 7/1934 |
| GB | 780922 | 8/1957 |

OTHER PUBLICATIONS

GB Search Report in a GB application 0023798.2.

PCT International Search Report in a PCT application PCT/EP 01/09754.

* cited by examiner

*Primary Examiner*—Lien M. Ngo
(74) *Attorney, Agent, or Firm*—Karen E. Klumas

(57) ABSTRACT

A protective packaging unit for a bottle or jar. The unit comprises a moulded plastic sheath which is closed at the top, open at the bottom, and releasably holds the bottle or jar, and has cutaway sections in opposite sides that enable the bottle or jar to be grasped between finger and thumb and pulled from the sheath. The packaged consumer product comprising the bottle or jar and the sheath is easy to assemble and to use.

10 Claims, 4 Drawing Sheets

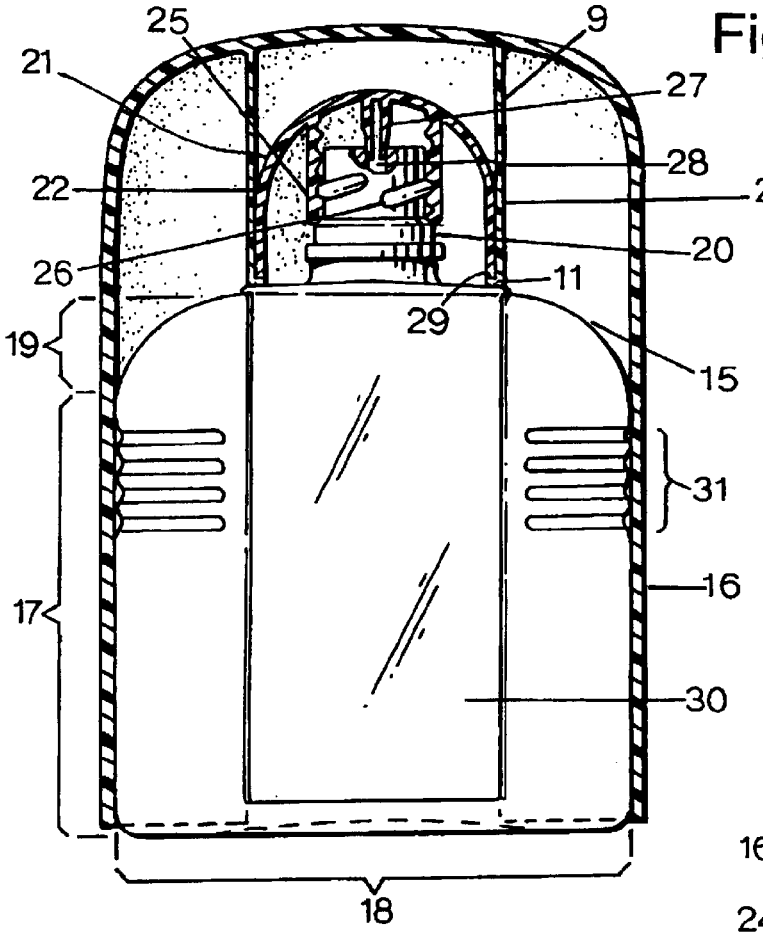
Fig.4.
Fig.5.
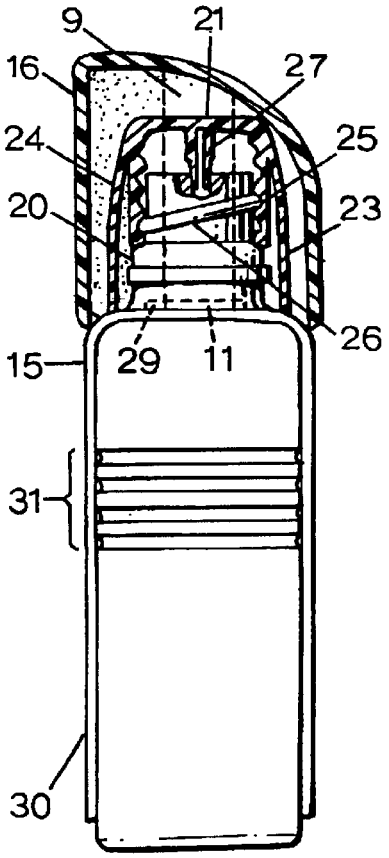
Fig.6.
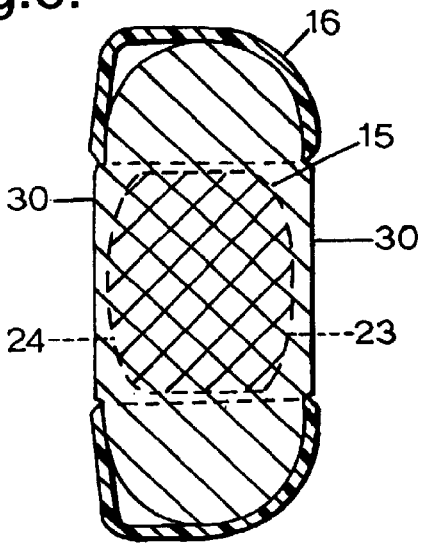

PROTECTIVE PACKAGING UNIT

FIELD OF INVENTION

This invention relates to protective packaging for consumer products contained within bottles or jars. More specifically, this invention relates to protective sheaths for consumer products and to methods for the protection of packaged consumer products using such sheaths.

BACKGROUND OF INVENTION

Many consumer products are supplied in bottles or jars. Often these bottles or jars are capable of being damaged during transit or on handling of the product in the warehouse, shop, or home. This is particularly true when the bottle or jar is made of a fragile material, such as glass. Methods of protecting such packaged consumer products from damage are known in the art and commonly comprise some kind of secondary packaging, such as protective boxes or sleeves. Examples of such packaging are described in GB 412,609 (Universal Seamless Containers Ltd.) and in GB 780,922 (Unilever Ltd.). Other examples of secondary packaging for consumer goods are aimed largely at improving the appearance of the packaged product, examples being described in U.S. Pat. No. 2,162,998 (Fisher) and U.S. Pat. No. 3,507,416 (Douglas et al).

The invention described herein is, in one aspect, a method of protective secondary packaging. The method described offers the additional benefits of ease of use by the consumer and open design, the latter benefit enabling much of the protected article to seen by the consumer prior to removal of the protective packaging. The ease of use of the present invention contrasts with many methods of secondary packaging, which make access to the contained consumer product difficult: removal of the secondary packaging being inconvenient and time-consuming. Other methods involving secondary packaging have the problem that the packaging is torn or damaged in some other way on removal, thereby preventing its re-use. Yet other methods involve secondary packaging that cover a large percentage of the consumer product, leading to a significant increase in the total pack cost and increased environmental impact, as well as the problem of the consumer being unable to see much of the protected article.

A further problem with many packaged consumer products supplied in bottles or jars is the ease with which they can be placed on supermarket shelves facing the wrong way, resulting in their label and/or logo not being immediately visible to the shoppers. This is particularly true of packages having similarly shaped fronts and backs. Use of a secondary packaging unit having front-back asymmetry around the jar or bottle can alleviate this problem.

Bottles or jars often present the additional problem that their surface has a low coefficient of friction, making them difficult to grip. This is true for many glass bottles and jars, for example. The low coefficient of friction of bottles and jars is a particular problem when there is a lubricant present, either on the surface of the bottle or jar or on the consumer's hand, an example being moisture from hand perspiration. An obvious solution to this problem would be to use a material having a higher coefficient of friction; however, this is not always desirable or possible. An alternative solution is the use of present invention.

SUMMARY OF INVENTION

In a first aspect of the present invention, there is provided a packaged consumer product that comprises a bottle or jar and a moulded plastic sheath therefor, said sheath being closed at the top, open at the bottom, possessing a means for releasably holding the bottle or jar, and having cutaway sections in opposite sides that enable the bottle or jar to be grasped between finger and thumb and pulled from the sheath.

In a second aspect of the present invention, there is provided a method for the protection from physical damage of a bottle or jar, characterised in that said method comprises surrounding the bottle or jar by a moulded plastic sheath therefor that is closed at the top, open at the bottom, possesses a means for releasably holding the bottle or jar, and possesses cutaway sections in opposite sides that enable the bottle or jar to be grasped between finger and thumb and pulled from the sheath.

DETAILED DESCRIPTION OF THE INVENTION

The current invention offers a means of direct protection from physical damage of a bottle or jar. The invention involves the use of a protective sheath, which is open at the bottom and possesses cutaway sections in opposite sides. These features enable easy addition and removal of the protective sheath from the bottle/jar. Additional benefits of these features of the invention are the reduced total amount of packaging material required and the high ease of manufacture of the sheath and the sheath-bottle assembly. The opening at the bottom of the sheath makes it particularly easy for the sheath to be placed on its associated bottle/jar during product assembly. The opening at the bottom of the sheath is required to be of sufficient size for the bottle/jar to pass through it.

An essential element of the invention is that the sheath possesses a means of releasably holding the bottle/jar. It is essential that the sheath is able to retain the bottle/jar during normal handling, but that the bottle/jar can be easily removed by exertion of a force that pulls it from the sheath, through the opening at the bottom.

The cutaway sections in opposite sides of the sheath extend through the full thickness of each side of the sheath. Preferably they extend to the bottom of the sheath, thereby easing the task of removing the bottle/jar from the sheath. For the same reason, it is preferred that the cutaway sections are of sufficient width for the consumer to easily grasp the bottle/jar between thumb and finger and pull it from the sheath. A minimum width of 1.5 cm, preferably 2.5 cm, is advantageous. In some embodiments even larger cutaway sections are preferred, for example, having a minimum width of 3 cm or even 3.5 cm; such large cutaways offer the additional benefit of improved display of the protected bottle/jar and any label or logo upon it.

The cutaway sections preferably extend from the bottom of the sheath to some point above half way up the sheath, preferably to some point over 60% of the height of the sheath. The cut-away sections are preferably centrally located with respect to the front and back of the sheath, preferably occupying from 20% to 80% of the width of the sheath, more preferably from 40% to 60%.

The bottle/jar and the associated sheath are preferably unitary items and there is preferably one sheath for each bottle/jar.

It is highly preferable that the sheath retains its integrity upon removal of the bottle or jar, thereby enabling its re-use. In this context, retention of integrity refers to the maintenance of wholeness and original shape and the lack of damage or alteration. The bottle/jar may then be reinserted into the sheath, through the opening at the bottom, where it may be held until its release is again desired.

It is desirable that the bottle/jar is held sufficiently firmly within the moulded plastic sheath that the assembly may be lifted, by grasping just the sheath, without the bottle/jar falling through the opening in the bottom of the sheath, even when the orientation of the assembly is such that the opening is facing towards the ground.

The removal of the bottle/jar from the sheath preferably does not require a great deal of force. It is desirable that said removal may be achieved by either grasping the sheath and exerting a firm downward jerk (with the assembly in a favourable orientation) or by pulling the bottle/jar from the sheath by hand. It is preferred that the force required to remove the bottle/jar from the sheath is between 15 N and 30 N. In all cases, the bottle/jar is removed through the opening at the bottom of the sheath.

The moulded plastic sheath is preferably resilient in nature, affording a high degree of protection to the associated bottle/jar. A contribution to the resiliency preferably comes from the outside surface sheath being hard enough to resist deformation during normal handling. The sheath is preferably moulded to have a shape that conforms to the shape of the body of the bottle/jar. The outer surface of the sheath preferably has a higher coefficient of friction than that of the bottle/jar, in order to make the product easier to grip. This is particularly advantageous when the packaged consumer product is one that is generally used in a high humidity environment, examples including 'bathroom' products, such as deodorants, antiperspirants, after shaves, and other cosmetic products.

The requirement that the sheath possesses a means of releasably holding the bottle/jar may be met by any means or any combination of means. One means involves closely fitting the moulded plastic sheath to the bottle/jar and/or any cap associated therewith. In this way, frictional interactions between the outside surface of the bottle/jar and the inside surface of the moulded plastic sheath may be sufficient to hold the former inside the latter. Alternatively, or additionally, the moulded plastic sheath may possess an element that is reversibly engaged with a cap or other part of the bottle/jar. An example of such an element is an internal projection protruding from the inside surface of the moulded plastic sheath and contacting the bottle or jar in a manner that aids the retention of the bottle or jar within the sheath. When present, such an internal projection preferably possesses a lug that is capable of contacting the underside of a protruding feature, or the upper face of an indentation, present on the associated bottle/jar. Such an internal projection is preferably accompanied by a second opposing projection that is capable of contacting a point on the associated bottle/jar directing opposite from the first, the two projections co-operating to firmly hold the associated bottle/jar. In a preferred embodiment, the two opposed projections protrude downwards from the top inside surface of the moulded plastic sheath and closely follow the sides of a cap upon the bottle or jar, each projection having an inward facing lug at or near its bottom that is able to reversibly slot into a slit at or near the bottom of opposite sides of said cap. Such projections preferably possess sufficient structural flexibility to flex around the cap or other protruding feature present on the bottle/jar when it is inserted and when it is removed. However, the projections must also have a certain degree of rigidity, in order to hold the bottle/jar when the sheath is lifted. The rigidity of the projections can be aided by the presence of stiffening struts running along the longitudinal axis of said projections and orientated orthogonally to them.

Alternative means of releasably holding the bottle/jar within the sheath may also be envisaged. One possibility is the use of magnetic interaction, in particular magnetic interaction between the top of the bottle/jar and the top of the sheath. This could be achieved by the inclusion of a magnet within the top section of the sheath in conjunction with the inclusion of a metallic iron element within the cap of the bottle/jar, or vice-versa.

It is highly desirable that the bottle or jar comprises a cap at its top, which is also held within the moulded plastic sheath when the latter is in place. The cap preferably fits externally over the mouth of the bottle/jar and may be removed to gain access to the contents of the bottle/jar and replaced to close off access to said contents. Any means may be employed for reversibly holding the cap onto the bottle/jar, for example the cap may be screw-threaded onto a neck section of the bottle/jar. The cap preferably possesses a skirt section, external to any screw-threaded element of the cap present but connected thereto at the top of the cap. The shape of the cap skirt defines the external appearance of the cap. In a preferred embodiment, the shape is that of an arch closed at both front and back. In this embodiment or another, it is preferred that the cap possesses slits, preferably at or near the bottom of opposite sides of the cap, that are capable of reversibly engaging with lugs on projections from the inside of the sheath, as previously described. It is preferred that the cap is made of relatively rigid plastic material, for example polypropylene or HDPE (high density polyethylene).

The moulded plastic sheath is preferably of asymmetric shape when viewed from at least one side. This is particularly useful when the associated bottle/jar does not itself possess such asymmetry. The front and back of the packaged consumer product are generally defined by the presence of a label or logo. It is desirable that the front of such a product faces forward when present on a supermarket shelf or similar retail outlet. The presence of front-back asymmetry in the shape of the sheath aids shelf stackers (whether human or mechanical) in achieving this desirable orientation. In addition, such asymmetry can aid the removal of the product from the shelf by the consumers. A preferred position for the front-back asymmetry of the sheath is at its top and/or sides; in particular, it is preferred that the highest point of the top is towards the back of the packaged consumer product.

The shape of the moulded plastic sheath is preferably such that the dimensions decrease in the direction: top-bottom height is greater than side-side width, which is in turn greater than front-back breadth. Hence a preferred shape is that of a non-cylindrical pipe which is closed at the top. It is also preferred that the dimensions of the packaged consumer product are such that the base of the bottle/jar and the bottom of the moulded plastic sheath are at approximately the same height when the former is fully inserted into the latter. This latter preference aids manufacture of the complete package on line and increases the extent of protection afforded to the bottle/jar.

The size of the moulded plastic sheath is dependent upon the bottle/jar with which it is associated. Preferred packaged consumer products are glass bottles and PET (polyethylene terephthalate) bottles (both usually comprising caps, as previously described) containing cosmetic compositions, for example bottles of after shave, deodorant, antiperspirant, perfume, skin care treatments, hair treatments, or oral care treatments. Typical dimensions for the sheaths of such products are height: 6 cm to 18 cm, especially 9 cm to 15 cm; side-side width: 5 cm to 10 cm, especially 7 cm to 9 cm; and front-back breadth: 2 cm to 6 cm, especially 2.5 cm to 4 cm.

A typical thickness for the main part of the sheath wall is 0.7 mm to 2.0 mm, especially 0.9 mm to 1.5 mm. At the cutaway sections of the sheath, it is preferred that the thickness of the sheath decreases towards said cutaway sections. A typical decrease is of the order of 50%, giving a sheath thickness of 0.35 mm to 1.0 mm, especially 0.45 mm to 0.75 mm, at the junction with the cutaway section.

A further preferred feature of the moulded plastic sheath is the presence of indentations in its outer sides. Such indentations can further increase the ease with which the product can be removed from the shelf or be otherwise handled. Indentations are preferred to projections for this purpose because the formers do not result in the need for more shelf space for the product. The following preferences apply to the indentations: that they are of a depth no greater than 50% the thickness of sheath walls, in particular from 0.3 mm to 3 mm, and especially from 0.5 mm to 1 mm; that they number from 2 to 6 per side, especially from 3 to 4 per side; that each indentation is of a maximum vertical width of from 2 mm to 6 mm, particularly from 3 mm to 5 mm; that they are positioned towards the centre of the sides of the sheath, preferably with their centre being within 20% of the mid-point of the top-bottom axis of the sheath; and that they are equidistant from each other, with respect to their top-bottom positioning, when more than two are present.

The moulded plastic sheath may be made from any suitable polymer. Preferred polymers, or polymer blends, have a flexural modulus of 1400 to 1800 N/mm$^2$, in particular 1500 to 1700 N/mm$^2$. Polypropylene and like materials are suitable; polypropylene homopolymer being particularly suitable, especially when having a flexural modulus of about 1500 N/mm$^2$. Certain additives may advantageously be included in the polymer to modify various attributes thereof. Antistatic agents are one example; additives that modify the surface for tactile or visual benefit are another. A particular example of the latter class of materials is Adflex polyproplene, which is preferably incorporated at a level of between 5 and 25% by weight. Other optional additives include materials that modify the slip characteristics of the polymer, such as siloxane polymers like Dow Corning MB 50-001, which is preferably incorporated at a level of between 0.05 and 6% by weight and improves the resistance to scuffing. Resistance to scuffing is particularly beneficial during the manufacture process, especially during the bringing together of the bottle/jar and the sheath (vide infra). High resistance to scuffing may also be achieved by use of polypropylene/polyethylene copolymers having a high melt flow index. A melt flow index of 80 to 100 degree/minute is typical for such materials, as is a flexural modulus of 1500 to 1700 N/mm$^2$. Incorporation of siloxane polymer can also be beneficial in achieving a narrow margin for the force required to remove the bottle/jar from the sheath.

METHOD OF MANUFACTURE

The moulded plastic sheath can be prepared by standard methods, for example injection moulding, independent of the bottle/jar. The method of manufacture of the packaged consumer product according to the invention comprises suitably orientating the bottle/jar and the pre-formed sheath relative to each other and then inserting the bottle/jar into the sheath through the opening at the bottom of the sheath, until the bottle/jar and the sheath are releasably engaged. Preferred means of achieving this involve conveyer belt transport of the bottle/jar to a position underneath the sheath, followed by lowering of the sheath onto the bottle/jar. Techniques such as robotic placement and rotary capping are particularly valuable.

DESCRIPTION OF DRAWINGS

The drawings illustrate a particularly preferred embodiment of the current invention. Each of the features described in the following description can be taken independently as a preferred feature of the invention as a whole.

FIG. 1 is the front elevation; FIG. 2 is a side cross-section; and FIG. 3 is a horizontal cross-section near the top of the sheath.

FIGS. 4 to 6 illustrate the same moulded plastic sheath, together with an inserted bottle. FIG. 4 is a front projection/cross-section; FIG. 5 is a side projection/cross-section; and FIG. 6 is a horizontal cross-section.

Figure 1:
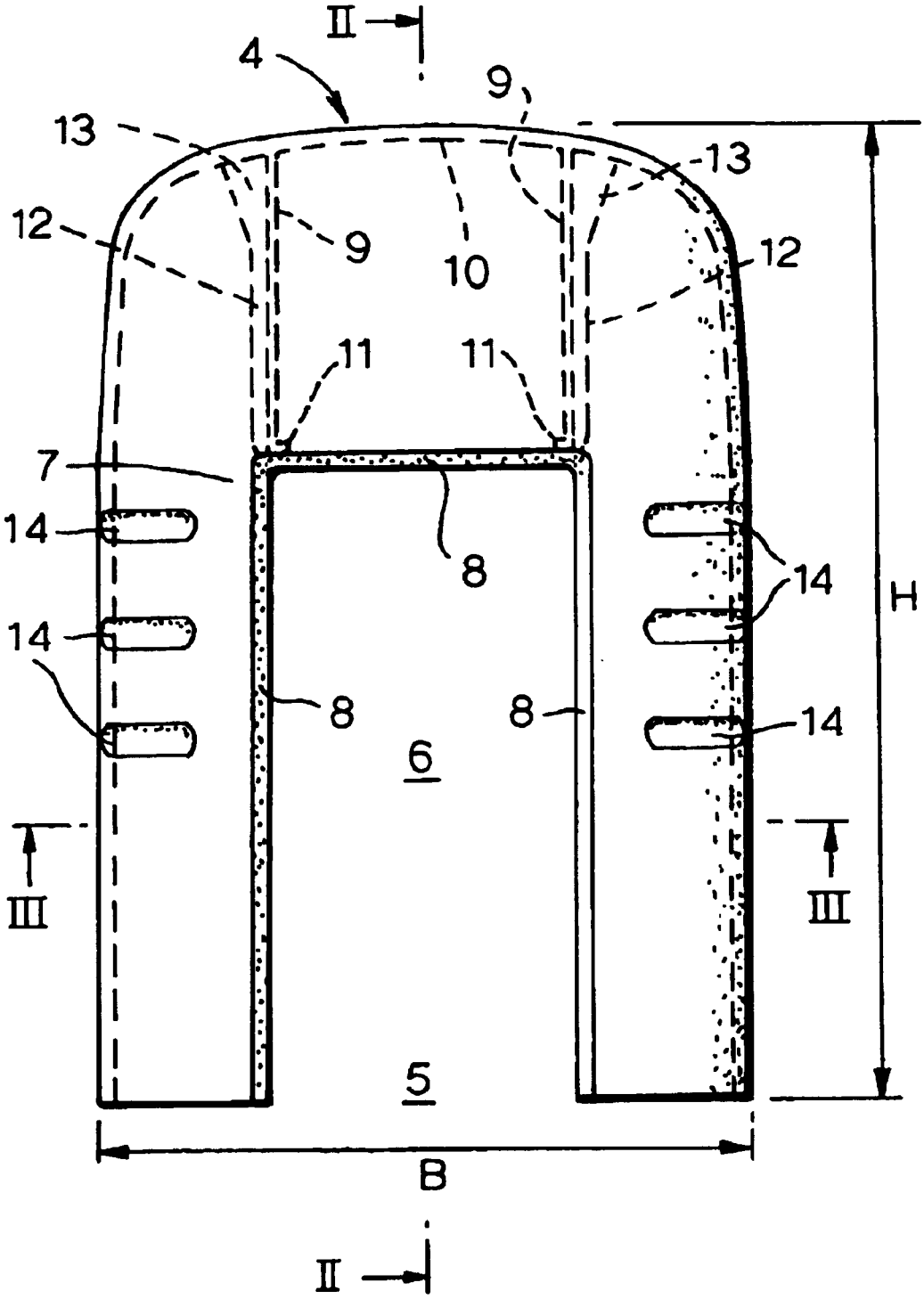
FIGS. 1 to 3 illustrate a moulded plastic sheath for a bottle.
Figure 2:
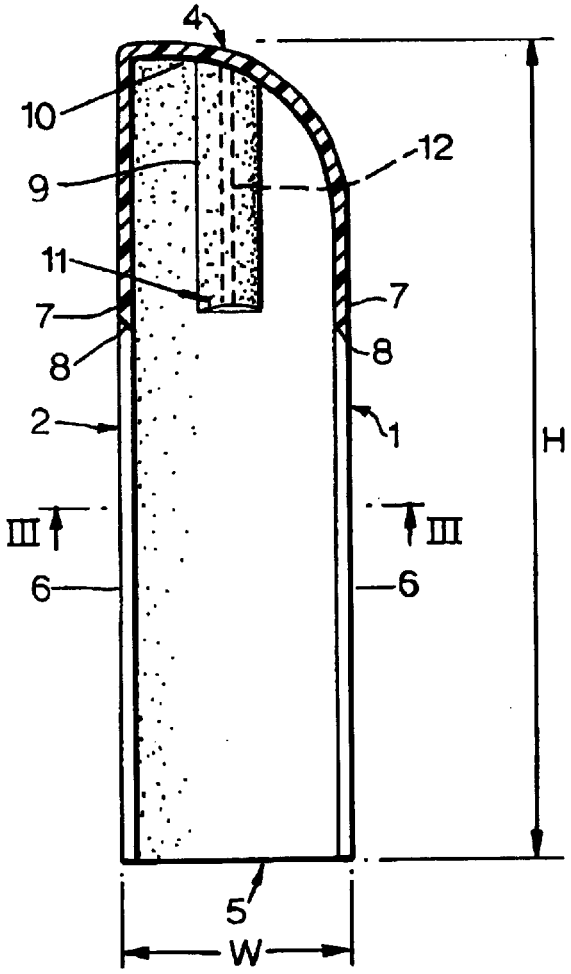
Figure 3:
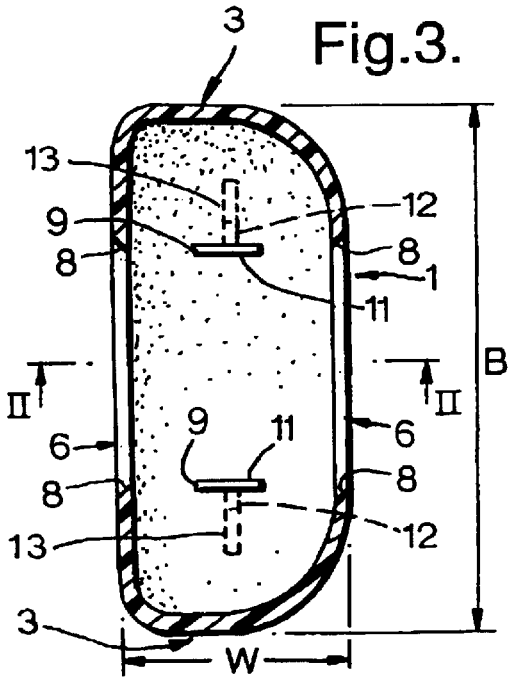
Figure 7:
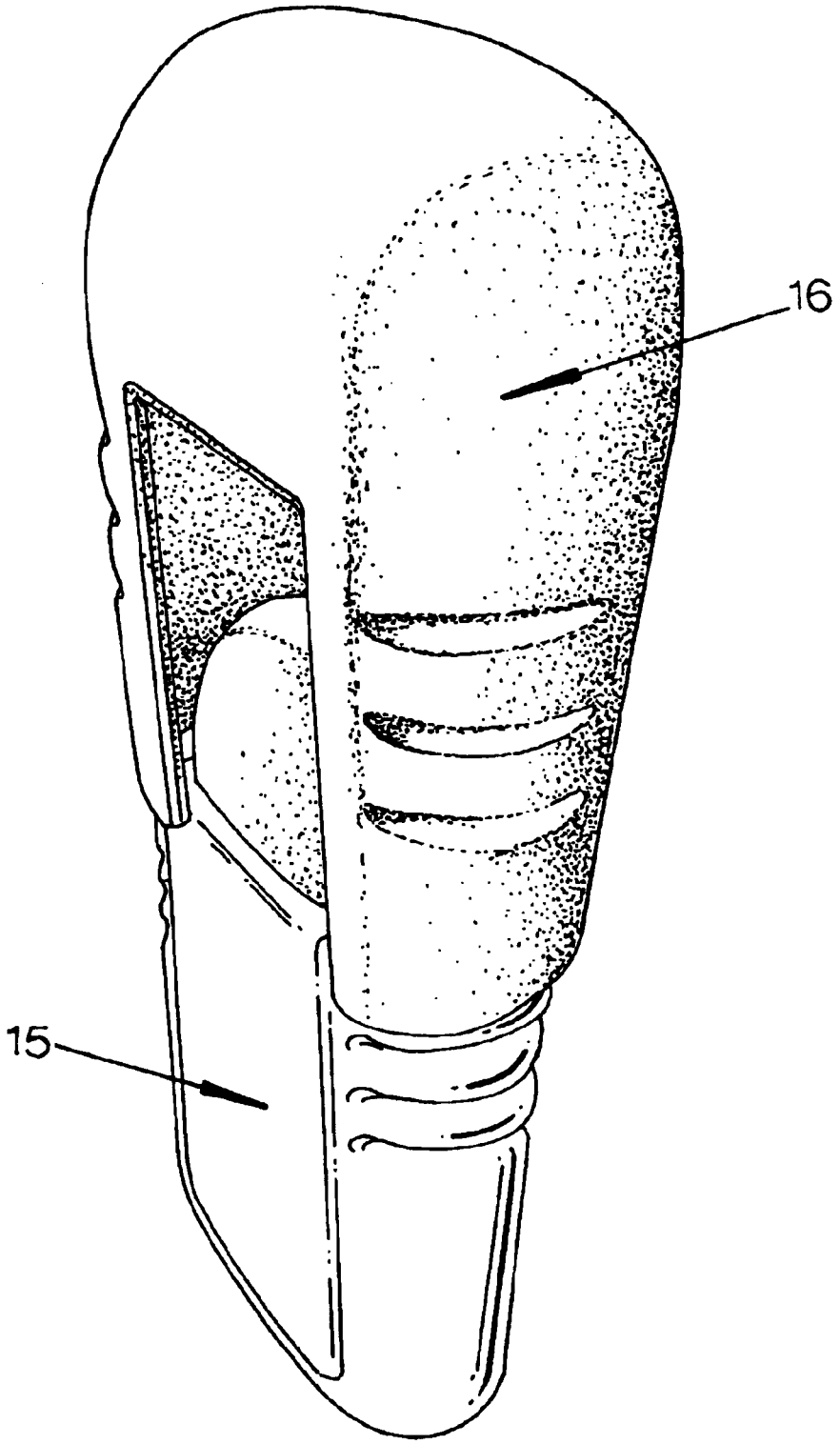
FIG. 7 is a perspective view illustrating the position at which the bottle is partially inserted into the sheath.

The sheath illustrated in FIGS. 1 to 3 has a front face (1) and back face (2) that are largely flat and parallel to each other. The sides (3) are orthogonal to the front face (1) and the back face (2) and curve into both of these faces; the radius of curvature into the front face (1) being greater than that into the back face (2). The front face (1), back face (2), and sides (3) of the sheath are vertical for most of their height, although there is some curvature towards the top of the sheath (4). The bottom of the sheath (5) is entirely void space. The ratio of the height of the sheath (H) to the width of the sheath (B) to the breadth of the sheath (W) is approximately 3.7:2.4:1. The same thickness of plastic, approximately, is used to make up the front face (1), back face (2), sides (3), and top (4) of the sheath.

Cutaway sections (6) are present in the front (1) and back (2) faces of the sheath. These cut-away sections (6) are approximately the same size and occupy the lower central area of both front (1) and back (2) faces. They extend across approximately 50% of the width of the front (1) and back (2) faces (the percentage being based on the maximum width of the sheath), and extend from the bottom (5) of the sheath to a height (7), approximately 65% up the sheath (the percentage being based on the maximum height of the sheath). The cut-away sections (6) each have an edge (8) that slopes away from the inside of the sheath at an angle of approximately 45°, in such a manner that dimensions of the cut-away sections (6) are slightly greater towards the outside of the sheath.

Two projections (9) extend vertically downward from the top internal surface of the sheath (10). They have the form of rectangular walls, orientated orthogonal to the front (1) and back (2) faces of the sheath and terminate just above the top (7) of the cut-away sections (6). Relative to the sides (3) of the sheath, they are positioned slightly inside the line of the edge of each of the cut-away sections (6). Relative to the front face (1) and back face (2) of the sheath, they are centrally located and occupy approximately 50% of the breadth of the sheath (the percentage being based on the maximum internal front-back breadth of the sheath). The thickness of the plastic making up the projections (9) is slightly less the thickness of the plastic making up the sides (3) of the sheath.

The projections (9) each possess a lug (11) on their inside surfaces at the bottom. These lugs (11) extend horizontally across the full width of the projections (9) and have a slightly convex shape when viewed from below. The lugs (11) are designed to reversibly interact with a slits in the cap of a bottle, of which more is said in relation to FIGS. 4 and 5. Each projection (9) also possesses a stiffening strut (12) on its outer surface. The stiffening struts (12) are orientated orthogonal to the projections (9) themselves, that is to say, parallel to the front face (1) and back face (2) of the sheath. They run the full length of the projections (9), along a central axis, getting wider towards the top in a delta-shaped section (13), as illustrated in FIG. 1.

Three indentations (14) are present in each side (3) of the sheath. These have a rectangular shape with the shorter sides being outwardly curved and the longer sides being straight (when viewed as in FIG. 1) and horizontal. The indentations (14) are evenly distributed approximately half way up the sheath. They penetrate into the side walls to a depth of approximately 50% with a curved cross-section.

The bottle (15), together with the sheath (16) into which it fits are illustrated in FIGS. 4 to 6. The body (17) of the bottle (15) is of a size to fit snugly within the sheath (16). Above the body (17), the bottle narrows, particularly across the width (18) of the bottle (15), where curved shoulders (19) exist. The narrowed bottle terminates in a screw-threaded neck (20), covered by a cap (21).

The neck (20) is circular in cross-section, whilst the cap (21) possesses an external skirt (22) having the shape of an arch closed at both the front and the back. The front face (23) and the back face (24) of the cap (21) are both slightly convex, when viewed from above, as illustrated in FIG. 6. From the top of the cap (21), on the inside, there drops a tube (25), of circular cross-section, that is smooth on the outside and has a screw thread on the inside designed to fit the screw thread (26) on the neck (20) of the bottle. The tube (25) terminates at a point slightly below the bottom of the screw thread (26) on the neck (20) of the bottle, when the cap (21) is fully threaded onto the bottle neck (20). Centrally located within the tube (23) there exists a hollowed spike (27) that blocks the outlet hole (28) of the bottle, when the cap (21) is fully threaded onto the bottle neck (20). The spike (27) is of circular cross-section and is wider at the top than at the bottom; at the bottom its outer diameter matches that of the bottle's outlet hole (28). When the cap (21) is fully threaded onto the bottle neck (20), the spike (28) protrudes a short distance through the outlet hole (28) of the bottle.

Particularly relevant features of the cap (21) are the slits (29) present at the bottom on both sides of the cap (21). One of these cut-away sections (29) is illustrated in FIG. 5. The lugs (11) present at the bottom of the projections (9) (see FIGS. 1 to 4) are designed to fit reversibly into these slits (29).

In addition to the aforementioned features, the bottle (15) possesses a raised central section (30) that runs from near the bottom of the bottle (15) at the front to near the bottom of bottle at the back. The front and back portions of this raised section are shaped to fit snugly within the cut-away sections (6) in the sheath (16), as illustrated in FIG. 6. There are also four indentations (31) equally spaced upon each side on the bottle (15) at a position slightly below the shoulder (19). These four indentations (31) are similar in shape to the three indentations (14) in the sides of the sheath (16), although they are of different dimensions, being longer [extending from near the raised section (30) at the front of the bottle to near the raised section (30) at the back of the bottle] and narrower. They are also more tightly spaced, the highest one being slightly below the shoulder (19) of the bottle (15) and the lowest one being approximately half way up the bottle.

What is claimed is:

1. A packaged consumer product comprising a bottle or jar and a reusable moulded plastic sheath therefor, said sheath being closed at the top and open at the bottom, said sheath also possessing a means for releasably holding the bottle or jar, and having cutaway sections in opposite sides that enable the bottle or jar to be grasped between a finger and a thumb and pulled from the sheath, the bottle or jar comprising a body and a cap at its top, both of which are held within the moulded plastic sheath when the moulded sheath is in place, and wherein the sheath reversibly engages with the cap.

2. A packaged consumer product according to claim 1, wherein the outer surface of the moulded plastic sheath has a higher coefficient of friction than the outer surface of the bottle or jar contained therein.

3. A packaged consumer product according to claim 1, wherein the moulded plastic sheath is closely fitted to the bottle or jar such that frictional interactions between the outside surface of the bottle or jar and the inside surface of the sheath hold the bottle or jar within the sheath.

4. A packaged consumer product according to claim 1, wherein the sheath comprises an internal projection protruding from the inside surface thereof and contacting the bottle or jar in a manner that aids the retention of the bottle or jar within the sheath.

5. A packaged consumer product according to claim 4, wherein the sheath comprises two opposed projections, that protrude downwards from the top inside surface thereof and closely follow the sides of the cap upon the bottle or jar, each projection having an inward facing lug at its bottom that is able to reversible slot into a slit at the bottom of each side of the cap.

6. A packaged consumer product according to claim 1, wherein the moulded plastic sheath is of asymmetric shape when viewed from at least one side.

7. A packaged consumer product according to claim 1, wherein the moulded plastic sheath extends to the full length of the associated bottle or jar.

8. A packaged consumer product according to claim 1, wherein the cutaway sections in opposite sides of the sheath extend to the bottom of the sheath.

9. A method for the protection from physical damage of a bottle or jar, wherein said method comprises surrounding the bottle or jar by a reuseable moulded plastic sheath therefor that is closed at the top and open at the bottom, said sheath also possessing a means for releasably holding the bottle or jar, and possesses cutaway sections in opposite sides that enable the bottle or jar to be grasped between a finger and a thumb and pulled from the sheath, the bottle or jar comprising a body and a cap at its top, both of which are held within and protected from physical damage by the moulded plastic sheath when the moulded sheath is in place.

10. A packaged consumer product that comprises a bottle or jar, and a reusable molded plastic sheath therefor, said sheath being closed at the top and open at the bottom, said sheath also possessing a means for releasably holding the bottle or jar, and having cutaway sections in opposite sides that enable the bottle or jar to be grasped between a finger and a thumb and pulled from the sheath, the bottle or jar comprising a body and a cap at its top, both of which are held within and protected from physical damage by the sheath when the sheath is in place.

* * * * *